United States Patent [19]

Ramnarace

[11] 4,111,728

[45] Sep. 5, 1978

[54] GAS GENERATOR PROPELLANTS

[76] Inventor: Jawaharlal Ramnarace, 117 E Escalones Ave., San Clemente, Calif. 92672

[21] Appl. No.: 767,877

[22] Filed: Feb. 11, 1977

[51] Int. Cl.[2] ..... C06B 45/10

[52] U.S. Cl. ..... 149/19.5; 149/5; 149/7; 149/19.6

[58] Field of Search ..... 149/5, 7, 19.5, 19.6

[56] References Cited

U.S. PATENT DOCUMENTS

| | | | |
|---|---|---|---|
| 2,130,712 | 9/1938 | Cairns | 149/5 |
| 2,222,175 | 11/1940 | Hauff et al. | 149/5 |
| 3,177,101 | 4/1965 | Vriesen | 149/19.6 |
| 3,223,478 | 12/1965 | Wilson | 149/7 |
| 3,493,445 | 2/1970 | Takata et al. | 149/7 |
| 3,993,514 | 11/1976 | Pacanowsky et al. | 149/19.5 |

*Primary Examiner*—Edward A. Miller
*Attorney, Agent, or Firm*—R. S. Sciascia; Roy Miller; Pohl, Lloyd E. K.

[57] ABSTRACT

A smokeless gas generator composition with an oxygenated binder such as a polyester or a polyether allows higher binder content with less solid oxidizer additives such as guanidine nitrate or ammonium nitrate and allows the composition to be cast.

6 Claims, No Drawings

GAS GENERATOR PROPELLANTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A large number of solid grain gas generators are produced for use on current missile control systems and aircraft starter turbines. Currently, the aircraft jet engine starter cartridge is the high quantity production item; however, almost every type of missile uses gas generators for various functions. Gas generators are required on numerous propellant actuated ballistic devices. A long felt need exists in the use of a relatively cool gas to inflate life rafts and similar devices; at present there is no completely satisfactory method of inflation.

Gas generators should evolve cool, clean inert gases in a reproducible manner suitable for driving turbines for secondary power devices and for gas servo systems. Most present day gas generators have flame temperatures of over 2000° F., (1093° C) and evolve gases containing solid particles which corrode and erode turbine blades and other mechanical hardware.

The usual gas generator composition, known in gas generator technology as the "propellant," is composed of ammonium nitrate oxidizer with a rubbery binder. Various chemicals ("ballistic modifiers") such as guanidine nitrate, oxamide and melamine are used in the propellant to aid ignition, give smooth burning, modify burning rates and give lower flame temperatures. Ballistic modifiers, such as sodium barbiturate, are used to reduce the temperature sensitivity of the propellant in order to give relatively constant burning rates with changes in temperature and pressure. Lithium oxalate may be used in place of the sodium barbiturate which produces erosive exhaust products. Carbon black is added to give more smooth, stable burning.

Ammonium nitrate is the most commonly used oxidizer since it gives maximum gas horsepower per unit weight and yields a non-toxic and non-corrosive exhaust at low flame temperatures. Further, it contributes to burning rates lower than those of other oxidizers. Ammonium nitrate is cheap, readily available and safe to handle. The main objection to ammonium nitrate is that it undergoes various phase changes during temperature changes causing cracks and voids if the binder is not strong and flexible enough to hold the grain together.

Ammonium nitrate compositiions are hygroscopic and difficult to ignite, particularly if small amounts of moisture have been absorbed. Since they do not sustain combustion at low pressures, various combustion catalysts are added to promote ignition and low pressure combustion as well as to achieve smooth, stable burning. Gas generator compositions used for driving turbines should contain no metallic additives or even oxidizers such as ammonium perchlorate since these give erosive and corrosive exhaust gases respectively.

Commonly used ballistic additives such as ammonium dichromate, copper chromite, Milori blue, carbon black, etc., are disadvantageous since they all produce solids in the exhaust gases.

Gas generator compositions are manufactured by pressing or extrusion and compression molding techniques. The solid particles are milled with a rubbery binder such as cellulose acetate, the solid "C" rubber type or polybutadiene-vinylpyridine and mixed under vacuum at temperatures of 170°-200° F (77°-93° C). After mixing, the composition is broken up into bits ("granulated") with granulator type equipment or cutting type grinders such as the Wiley mill. This is an extremely hazardous operation and must be done remotely.

After granulation, the composition is loaded into molds of the required shapes and pressed to about 7000 psi. (4921 Kg/Sq.cm.) With certain types of binder, the molds are heated to about 180° F (82° C) until the composition is cured or vulcanized. The grain is then machined to size and potted into the gas generator cases. The molds, mills and extrusion equipment are costly; the lengthy process time further increases the cost of manufacture. It is especially difficult to produce large grains by this technique.

The castable case-bonded system which is the standard and preferred method of producing large solid rocket propellant grains would result in tremendous savings to the gas generator producer since the need for expensive compression molding equipment would be eliminated. The main problem is producing castable gas generators in a manner similar to solid rocket propellants is that ammonium nitrate has a relatively low density (1.73 g/ml) as compared to ammonium perchlorate (1.95 g/ml) or aluminum (2.7 g/ml) and this property, coupled with the pourous nature of the crystals, requires high binder levels for castable compositions. These high binder levels (25–30%) result in gas generators which emit excessive quantities of smoke. Also, water may be absorbed from the air by the ammonium nitrate if conventional propellant processing techniques are used.

SUMMARY OF THE INVENTION

By employing an oxygenated polymeric binder such as polyether or polyester a gas generator composition can be formulated with higher binder levels, thereby allowing the composition to be cast directly into its casing. This type of composition also produces a very clean, low temperature, reproducible flame.

Binders wherein the oxygen is pendant are preferred. Ammonium nitrate is a preferred oxidizer, it may be modified for better castability by coating it with magnesium oxide. Other ballistic modifiers can be added to the composition.

Compositions of 20 to 40 percent carboxyl terminated polydiethylene adipate binder, 45 to 60 percent ammonium nitrate and small amounts of quanidine nitrate and oxamide burn rate modifiers have proven to be excellent gas generator propellant compositions.

DESCRIPTION OF THE PREFERRED EMBODIMENT

Examples of compositions prepared according to the present invention appear in the charts below wherein:

M = average molecular weight of exhaust gases;
$T_c$ = flame temperature, chamber;
$T_e$ = exhaust gas temperature;
C* = characteristic exhaust gas velocity, ft./sec;
C = correction factor for standard conditions;
E = $\epsilon$ = nozzle expansion ratio = area of nozzle exit ÷ area of nozzle throat;

$I_{sp}$ (vac) = Ivac specific impulse, vacuum conditions;
$I_{sp}$ (ref) = Ivef = specific impulse, reference conditions;
CH = composition of chamber gases (mole fraction); and
Ex = compositon of exit gases (mole fraction).

| | | | | | | |
|---|---|---|---|---|---|---|
| Binder ($C_{10}H_6O_5$) | | 25 | | 25 | | 25 |
| Guanadine Nitrate | | 10 | | 5 | | 5 |
| Oxamide | | 15 | | 20 | | 25 |
| Ammonium Nitrate | | 50 | | 50 | | 45 |
| $T_c$ | | 1107.24 | | 1079.9 | | 1045 |
| $T_f$ | | 719.96 | | 700 | | 668 |
| M | | 24.0 | | 24.58 | | 25.34 |
| C* | | 3354 | | 3272 | | 3170 |
| $I_{vac}$ | | 185 | | 181 | | 175 |
| $I_{ref}$ | | 170 | | 166 | | 161 |
| | CH | EX | CH | EX | CH | EX |
| $CH_4$ | .0684 | .0991 | .088 | .1034 | .1135 | .1090 |
| CO | .1295 | .0099 | .1200 | .0065 | .1012 | .0030 |
| $CO_2$ | .1411 | .1883 | .1560 | .1835 | .1697 | .1687 |
| $H_2$ | .21401 | .1252 | .1930 | .1036 | .1637 | .0739 |
| $H_2O$ | .2407 | .3007 | .236 | .3116 | .2272 | .3222 |
| $NH_3$ | | | | | | |
| $N_2$ | .2054 | .2168 | .2056 | .2111 | .2093 | .2080 |
| $C_{(s)}$ | 0 | .0597 | 0 | .0801 | .0145 | .11495 |

| | | | | |
|---|---|---|---|---|
| Binder ($C_{10}H_6O_5$) | 30 | 30 | 30 | 40 |
| Ammonium Nitrate | 60 | 55 | 50 | 50 |
| Guanadine Nitrate | 5 | 10 | 10 | 5 |
| Oxamide | 5 | 5 | 10 | 5 |
| M | 23.14 | 23.32 | 24.03 | 24.53 |
| $\rho$ (g/cc) | 1.496 | 1.468 | 1.466 | 1.442 |
| $T_c$ (° K) | 1158 | 1144 | 1104 | 1082 |
| $T_f$ (° K) | 754 | 749 | 726 | 720 |
| C* | 3500 | 3467 | 3353 | 3294 |
| $C_f$ | 1.63 | 1.63 | 1.64 | 1.64 |
| E | 9.9 | | | |
| $I_{sp}$(vac) | 193.1 | 191.5 | 185.7 | 182.7 |
| $I_{sp}$(ref) | 177.2 | 175.7 | 170.4 | 167.5 |

| | CH | EX | CH | EX | CH | EX | CH | EX |
|---|---|---|---|---|---|---|---|---|
| $CH_4$ | .0408 | .09118 | .0518 | .09293 | .08262 | .09938 | .11399 | .10473 |
| CO | .15035 | .02005 | .14846 | .01768 | .13802 | .01096 | .13392 | .00897 |
| $CO_2$ | .12518 | .20295 | .12747 | .19746 | .14363 | .18299 | .15268 | .16918 |
| $H_2$ | .24948 | .16865 | .24248 | .16089 | .21401 | .13193 | .19519 | .12295 |
| $H_2O$ | .25152 | .28656 | .24143 | .28526 | .22761 | .29432 | .21124 | .29304 |
| $NH_3$ | .00078 | .00015 | .00081 | .00015 | | | | |
| $N_2$ | .18186 | .19902 | .18753 | .20175 | .19326 | .19907 | .16320 | .16097 |
| $C_{(s)}$ | 0.0 | .03143 | 0 | .04658 | 0 | .08119 | .02898 | .14008 |

The binder ($C_{10}H_6O_5$) used in the above-described compositions was carboxyl terminated polydiethylene glycol adipate. Other oxygenated binders of course, can be used such as amine terminated polyethers, or polyesters. Binders where the oxygen is pendant and thus more readily available for combustion are preferred.

Oxygenated binders have lower carbon content for a cleaner smoke. Also, since the carbon is already partially oxidized, lower heats of combustion are obtained in the calculated range of 900° to 1200° F (482°–649° C). These facts are demonstrated by the compositions charted above.

Fluorinated binders should be avoided as they may produce corrosive or toxic exhaust gases such as HF and are more expensive to produce.

The choice of binder should be guided by the criteria previously discussed, not by the characteristics desired in a rocket propellant, as gas generator propellant compositions have quite different objectives, such as reproducibility, slow burn rate, and cool, clean exhaust. Rocket propellants, on the other hand, strive for high energy, and thus produce high burn rates and hot exhaust.

Guanidine nitrate and oxamide are used to alter the burn properties of the composition. Guanidine nitrate is an oxidizer but it does not contain as much oxygen as ammonium nitrate (AN); it is used to make the composition burn smoothly and primarily as a ignition aid. Oxamide is used to lower the flame temperature and burn rate.

Other additives may be employed such as about 1–2% carbon black for smooth burning or 1% sodium barbiturate to lower temperature sensitivity of the composition. Nitroplasticizers such as trimethylenetrinitrate can be added for more energy and to aid ignition. Oxygen containing plasticizers such as triacetin can be used to aid processing and promote cleaner burning.

The addition of small amounts of magnesium oxide to the ground ammonium nitrate (AN) during drying reduces moisture pick-up on the surface of the ammonium nitrate and allows it to bond better to the binder.

This allows the gas generator propellant to be cast using conventional rocket propellant techniques. In the charted compositions, 0.2 weight percent MgO was blended with the AN and dried in an oven at 180° F (82° C) about 12 to 24 hours. The AN used was (−100/+200) mesh. Magnesium nitrate may be used in lieu of magnesium oxide.

The composition can processed using standard techniques. A standard di- or tri-functional epoxy curative can be used. The charted compositions were mixed at 150° F (66° C) and cured at 180° F (82° C) for two days. It was found that the use of MgO shortens curing time.

Pressed compositions using lesser amounts of the type of binder described here can also be made. They would have increased gas horsepower and still provide the significant advantages of improved ballistic reproducibility, lowered burning rates, and absence of smoke and exhaust solids.

What is claimed:

1. A castable gas generator composition comprising:

between 25 and 40 weight percent of a binder of polyether or polyester;

between 45 and 60 weight percent ammonium nitrate coated with a compound selected from the group consisting of magnesium oxide and magnesium nitrate; and an effective amount of burn rate modifier.

2. The composition of claim 1 wherein said binder contains pendant oxygen-containing groups.

3. The composition of claim 2 wherein said binder is a carboxyl terminated polyester.

4. The composition of claim 1 wherein said burn rate modifier is guanidine nitrate.

5. The composition of claim 4 wherein said binder contains pendant oxygen-containing groups.

6. The composition of claim 5 wherein said binder is polydiethylene glycol adipate.

* * * * *